US005576134A

United States Patent [19]

Ogawa et al.

[11] Patent Number: 5,576,134

[45] Date of Patent: Nov. 19, 1996

[54] TWO-COMPONENT TYPE DEVELOPER AND IMAGE FORMING PROCESS

[75] Inventors: Keiko Ogawa; Michiaki Ishikawa; Meizo Shirose, all of Hachioji, Japan

[73] Assignee: Konica Corporation, Japan

[21] Appl. No.: 346,015

[22] Filed: Nov. 29, 1994

[30] Foreign Application Priority Data

| | | | |
|---|---|---|---|
| Nov. 30, 1993 | [JP] | Japan | 5-300055 |
| Nov. 30, 1993 | [JP] | Japan | 5-300057 |
| Feb. 1, 1994 | [JP] | Japan | 6-010613 |

[51] Int. Cl.[6] ..... G03G 13/09

[52] U.S. Cl. ..... 430/122; 430/108

[58] Field of Search ..... 430/106.6, 122, 430/108

[56] References Cited

U.S. PATENT DOCUMENTS

| | | | |
|---|---|---|---|
| 4,242,434 | 12/1980 | Hirakura et al. | 430/122 |
| 4,822,708 | 4/1989 | Machida et al. | 430/106.6 |
| 5,202,731 | 4/1993 | Tanikawa et al. | 430/122 |
| 5,260,159 | 9/1993 | Ohtani et al. | 430/106.6 |

FOREIGN PATENT DOCUMENTS

| | | |
|---|---|---|
| 0357042 | 10/1990 | European Pat. Off. . |
| 39008 | 7/1960 | Luxembourg . |
| 1102411 | 2/1968 | United Kingdom . |

OTHER PUBLICATIONS

Derwent Abstract (1 page) JP4124679 A 920424.
Derwent Abstract (1 page) JP1123250 A 890516.
Derwent Abstract (1 page) JP60043667 A 850308.
Derwent Abstract (1 page) JP800171744—May 12, 1980.

*Primary Examiner*—John Goodrow
*Attorney, Agent, or Firm*—Jordan B. Bierman; Bierman & Muserlian

[57] ABSTRACT

Disclosed is a two component type developer for negatively chargeable developer use, comprising a carrier and a colored toner particle comprising a binder resin and a colorant, wherein said carrier comprises a magnetic particle having thereon a resin coated layer containing a resin and a magnesium compound.

15 Claims, 3 Drawing Sheets

TWO-COMPONENT TYPE DEVELOPER AND IMAGE FORMING PROCESS

FIELD OF THE INVENTION

This invention relates to a two-component type developer and an image forming process in which the two-component type developer is used.

BACKGROUND OF THE INVENTION

Heretofore, for a developer applicable to the image formation in an electrophotographic system, two kinds of roughly classified developers have been used, namely, a single-component type developer and a two-component type developer. Particularly among color developers, a two-component type developer has been advantageous from the point that a stable charging property can be secured.

As the multicolor image forming processes in which the two-component type developer is used, there have been two known developing processes, namely, a contact developing process characterized in making use of an intermediate image transfer member and a non-contact developing process characterized in putting colors on a latent image carrier one over another without making use of any intermediate image transfer member. From the viewpoint that the process itself can be miniaturized, the non-contact developing process has been advantageous.

However, in a simple non-contact developing process, a developability is usually deteriorated as compared to the contact developing process. JP OPI Publication No. 3-271753/1991 and so forth, therefore, overcome the above-mentioned problem in such a manner that a developer layer is made thinner to bring a distance between a latent image carrier member and a developer carrier member (developing roller) closer so that the electric field of a development can be intensified.

As a means for achieving an extreme thin developer layer, there are the following known means; namely, Item 1. a means for pressing a developer layer regulating rod against the surface of a developing roller;

Item 2. another means for regulating a developer layer by bringing an elastic blade into contact with the surface of a developing roller; and Item 3. a further means for regulating a developer layer by keeping a specific gap between a non-elastic blade and the surface of a developing roller.

Among the means, the following means are effective to form a layer having a stable layer thickness, namely; a means for pressing a developer regulating rod against the surface of a developing roller, mentioned in item 1; and a thin layer forming process carried out by making use of a rigid rod-type magnetic member, that is proposed in JP OPI Publication No. 2-50184/1990. However, when making use of the above-given processes, there is such a disadvantage that a developer used therein is received by an excessive stress, though there is such an advantage that a stable layer can be formed. Particularly when miniaturizing an equipment, it is expected that the state of things may getting more serious. The increase of the above-mentioned stress in forming a thin layer may cause the destroy or peeling-off of a carrier-coated layer and may also seriously affect the durability of a developer used.

With the advance of the miniaturization of an equipment and a developing apparatus, it becomes an important thema for a two-component type developer how to electrically charge rapidly and properly within a period between a time when a toner is supplied and a time when the toner is transferred to a development nip section. Heretofore, it has been usual to add a negatively chargeable charge-control agent to a toner so as to improve the charge-rising property of a negatively chargeable developer. However, when making use of such a miniaturized developing apparatus as mentioned above, only the addition of a charge-control agent is not enough, because a toner is scattered in the developing apparatus and an image is also seriously fogged by the increase of the amount of a weakly charged toner. As a means for improving an electric charge rising property on a carrier side, a positive charge control agent is added to a carrier, such as described in JP OPI Publication No. 2-8860/1990. The positive charge controlled agents include, for example, a quaternary ammonium compound such as those disclosed in JP OPI Publication No. 52-10141/1977, and an alkyl pyridinium compound and an alkyl picolinium compound (including, for example, nigrosine SO and nigrosine EX) such as those disclosed in JP OPI Publication Nos. 56-11461/1981 and 54-158932/1979. These charge control agents an organic compound having a high cohesive property and, accordingly, they have a poor dispersibility. It has, therefore, been liable to produce a charge failure with toner, because a charge control agent is maldistributed or extricated in the coated layer of a carrier. When a toner component is fused to a carrier, that is, when producing a so-called spent in making a multicopying, the charge rising property cannot be stabilized in making the multicopying, because a charge control agent component made present on the surface of the carrier is covered by the toner component.

As described in JP OPI Publication Nos. 57-168256/1982, 59-228261/1984, 63-71860/1988 and 2-110577/1990, the attempts for improving the environmental differences of chargeability between developers have been tried to inhibit the variation of a water-absorption by covering a magnetic particle with a silicon resin or by adding an inorganic fine particle subjected to a hydrophobic treatment to a coated layer.

However, even in the above-mentioned attempts, the hydrophobic treatment cannot be enough for allowing to stand under the conditions of a high temperature and a high humidity for a long time, but a variation of the charging function of a carrier is observed and, there still remains such a problem that a developability is varied by the variation of the amount of a developer transported, that is produced in a thin-layer forming section by the variation of the above-mentioned charging function of the carrier.

As the means for preventing a chargeability variation produced by a toner-spent, it has been carried out the addition of silica with the purpose of abrading a spent toner, as described in JP OPI Publication Nos. 54-21730/1979, 58-117555/1983 and 59-232362/1984. However, silica applied thereto has a few abrading effect, because it is usually the spherical form. Further, in the case of such a system having a great stress as in a thin-layer forming process, silica has such a defect that it is split off. Therefore, the abrading effect of the silica cannot be kept on, though the spent production may be relatively retarded as compared to a carrier without adding silica thereto, and silica is completely split off after making a multicopying and, thereby, a lot of the spent are produced. Therefore, a charged amount is seriously varied so that a toner flying and a background fog are resultingly induced.

SUMMARY OF THE INVENTION

It is an object of the invention to provide each of such a developer and an image forming process as that a charge-rising property is excellent, that neither fog nor toner flying can be produced for a long time, particularly that a carrier coated layer cannot be destroyed even in a thin developer layer forming process that may give a great stress to a developer, and besides that any toner spent cannot be produced on a carrier.

To try to improve a charge-rising, the positive chargeability of a carrier is robe improved. Further, to prevent a toner spent production, an abrading effect is to be provided to a carrier. The objects of the invention can be achieved thereby or by the following constitution.

The above-mentioned problems can be solved in the following image forming process. In an image forming process comprising making a developer comprising a colored toner particle containing at least a binder resin and a colorant and a carrier to be a thin developer layer having a thickness within the range of 20 to 800 μm by making use of a developer regulating member and non-contact developing an electrostatic latent image on a latent image carrier member, wherein the above-mentioned carrier is a carrier for negatively chargeable developer use that is coated with a magnesium compound and a resin over a magnetic particle. A magnesium compound of to the present invention can be selected from the group consisting of magnesium oxide, magnesium hydroxide and a hydroxidized magnesium compound.

And, in the course of preparing the above-mentioned carrier of the invention, magnesium oxide, magnesium hydroxide and a hydroxidized magnesium compound each applicable thereto are preferable to have a single crystal structure in which a crystal is grown up in a vapor-phase reaction.

DETAILED DESCRIPTION OF THE INVENTION

Figure 1:
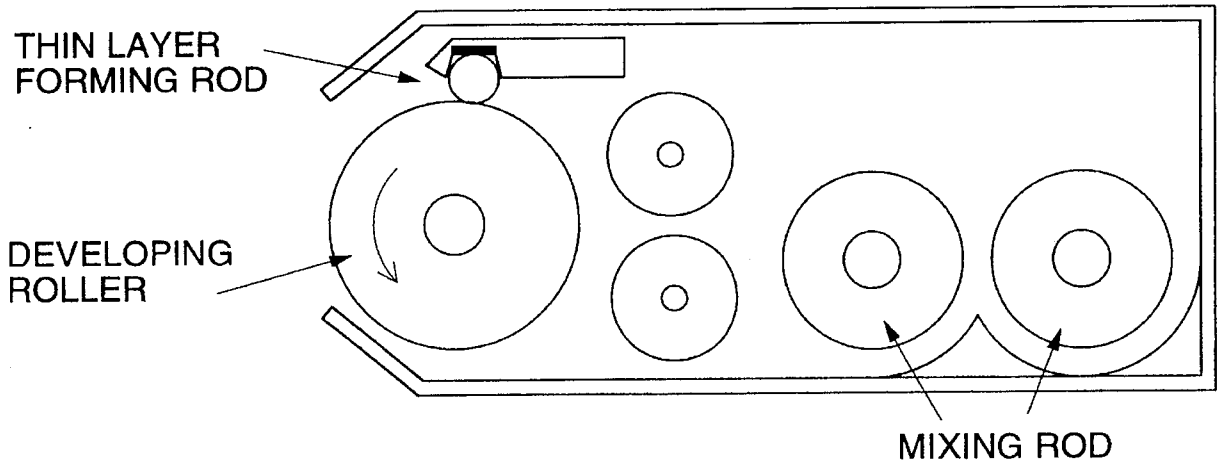
FIG. 1 illustrates a rod type development unit.

The cause of varying a charged amount under the conditions of a high temperature and a high humidity is a charging property variation produced by that the component materials of a developer absorb the water content of the air in the course of aging the developer.

Particularly about a carrier, it has been tried to prevent the carrier from the above-mentioned variation of a water-absorption, by adding an inorganic fine particle subjected to a hydrophobic treatment to a coated layer.

However, the above-mentioned measure has still not been satisfactory.

A magnesium hydroxide compound or a magnesium compound subjected to a hydroxidizing treatment used in the present invention is excellent in the aging stability of the charging property to a water-content in the air and capable of displaying an excellent positive chargeability. Therefore, a carrier containing the compound can give a stable negative-charge to a toner for a long time even under the conditions of a high temperature and a high humidity.

Further, by adding magnesium oxide compound of the present invention to a carrier, the above-mentioned effect can be achieved. The reason thereof is that magnesium oxide compound has a very high positive chargeability, so that a toner can readily be negatively charged when adding it to a carrier. Therefore, a charge rising property can be excellent and neither fog nor toner flying may be produced even when a small amount of a developer is used. Besides the above, a stable charge rising property can be enjoyed for a long time, because it is a hard inorganic material and, when it is composed of single crystal structure, a toner spent produced when carrying out a multicopying operation can gradually be shaved off by the friction of the carriers each having a sharp edge.

Carrier Applicable to the Present Invention

Magnetic particle

Magnetic particles include, for example, those made of iron, ferrite or magnetite, those made of a metal such as iron, nickel or cobalt and an alloy or a compound containing such a metal as given above. Among them, it is preferable when making use of a magnetic particle having (a density within the range of 3 to 7 g/cm$^3$), because they may readily be mixed up in a developing apparatus and also because a stress may be reduced when a developer receives the stress when they are stirred to be mixed up.

Besides the above, when carrying out a non-contact development, a developer layer is to inevitably be thinned. It is, therefore, preferable that a saturated magnetization is to be within the range of 15 to 40 emu/g and a volume average particle-size is to be within the range of 10 to 60 μm.

Resin for carrier coating

As a coating resin for constituting the resin-coated layer of a carrier, there is no special limitation thereto, provided that a resin can give a negatively frictional charge to the subject toner, by the friction with the toner. The resins applicable thereto include, for example, a styrene type resin, an acrylic type resin, a styrene-acrylic resin, a vinyl type resin, an ethylene type resin, a rosin-denatured resin, a polyamide resin and a polyester resin. These resins may also be used in combination.

Magnesium oxide

Magnesium oxide can be prepared by heat-decomposing magnesium carbonate, magnesium hydroxycarbonate or magnesium hydroxide. Magnesium oxide prepared in a vapor-phase reaction can be prepared by oxidizing a metal magnesium at an oxygen atmosphere. Magnesium oxide prepared in this process is high in purity and capable of making the particle-size thereof smaller.

Magnesium hydroxide

Magnesium hydroxide may be prepared by adding an alkali to an aqueous solution of a magnesium salt of magnesium oxide and then by heating and pressurizing the resulting mixture.

Magnesium hydroxide prepared in a vapor-phase reaction can be prepared by hydroxidizing a metal magnesium vapor in a steam atmosphere.

Hydroxidized magnesium compound

Hydroxidized magnesium compound can be prepared by hydroxidizing magnesium oxide, magnesium carbonate or the like. A hydroxidizing treatment is carried out by making aqueous vapor act on magnesium oxide or magnesium carbonate. To be more concrete, the above-mentioned treatment may be performed by allowing the particle of magnesium oxide or magnesium carbonate to stand for one hour under the atmosphere of 50° C. and 80% RH. In this case, they may be mixed up in a specific vessel or may also be treated by making use of a fluidized bed device.

A process for preparing magnesium oxide or magnesium carbonate which is to serve as a core may be performed in the following manner. For example, a trihydrate crystal may be prepared in such a manner that, while putting carbon dioxide through an aqueous magnesium salt solution, sodium carbonate is added thereto. And, an anhydrous salt may be prepared by drying and dehydrating the trihydrate salt crystal in carbon dioxide flow. Further, with magnesium prepared in a vapor-phase reaction, a single crystal may be produced by reacting a metal magnesium vapor with and in the atmosphere of aqueous vapor containing carbon dioxide.

In this patent specification, the expression, a "vapor-phase reaction", means a "vapor with vapor reaction", namely, a reaction of a metal magnesium vapor with a gas (such as oxygen gas, aqueous vapor and carbon dioxide gas) for forming a magnesium compound.

Also in this patent specification, a magnesium compound produced in any other processes than the above-mentioned process of "vapor-phase reaction" shall be regarded as a "polycrystal magnesium compound".

It is preferable that a magnesium compound particle applicable to the invention is to have a number average particle-size within the range of 1 to 200 nm and a BET specific surface area within the range of 500 to 10 $m^2/g$. However, from the viewpoint of dispersibility, it is further preferable that such a particle as mentioned above is to have a number average particle-size within the range of 5 to 120 nm and a BET specific surface area within the range of 200 to 10 $m^2/g$, respectively. If a particle has a particle-size of smaller than 1 nm or a specific surface area of not narrower than 500 $m^2/g$, a spent prevention effect can hardly be realized. If a particle has a particle-size of exceeding 200 nm and a specific surface area of not wider than 10 $m^2/g$, the dispersion thereof in a coated layer can hardly be made and the free components thereof are increased, so that the chargeability thereof to a toner is liable to be spoiled.

The above-mentioned number average particle-size is to be obtained from an image magnified 10,000 times through a transmission type electron microscope.

A magnesium compound may be added in a proportion within the range of, preferably, 0.5 to 70% by weight in a coated layer and, more preferably, 1 to 60% by weight therein. If a proportion to be added is less than 0.5% by weight, the effects would not be satisfactory and, if exceeding 70% by weight, a coated layer can hardly be formed, because there are too much inorganic substances, so that a durability deterioration such as a delamination of a layer may be induced.

A layer thickness of a carrier-coated layer is to be within the range of, preferably, 0.5 to 4.5% by weight of an amount containing a resin particle and, more preferably, 1.0 to 3.0% by weight thereof. If a coated layer thickness is thinner than 0.5% by weight, the destroy of a core (or a magnetic particle) is liable to produce when preparing a carrier, so that there may be a danger of producing the unevenness of a coated layer. On the contrary, if exceeding 4.5% by weight, an adhesion force to a magnetic particle may be lowered, because a coated layer thickness is increased, so that a layer delamination and so forth may be induced.

Toner

Any common types of toner may be used. It is, however, preferable to use a toner externally added with an inorganic fine particle capable of improving a developability and cleanability through the improvement of a fluidity.

As the above-mentioned inorganic fine particles, the following fine particles are preferably be used from the viewpoints of a capability of providing a negative chargeability and an effect of improving a fluidity; namely, a hydrophobic silica fine particle and a hydrophobic titania fine particle each treated on the surface thereof with a coupling agent containing an alkyl group.

As for the binder resins, a polyester resin is preferably used from the viewpoint of the capacity of providing a negative chargeability. Besides, for more improving a charge rising property, it is further preferable to add a negatively chargeable charge control agent such as an azo type chrome complex.

Process for Forming a Thin Layer

Developer Layer Thickness

A layer thickness is to be within the range of, preferably, 20 to 800 μm and, more preferably, 20 to 500 μm. If it is not thicker than 20 μm, the subject developer cannot be formed into a satisfactory and stable layer. If it is not thinner than 800 μm, the developer may be seriously scattered about by a centrifugal force produced by the rotation of a developing roller.

The developer layer thickness of the present invention is defined as a developer layer thickness at the point on the surface of a developer carrier member (a developing roller) closest to a photoconductor. The developer layer thickness can be calculated by using an optical microscope with a scale.

Figure 2:
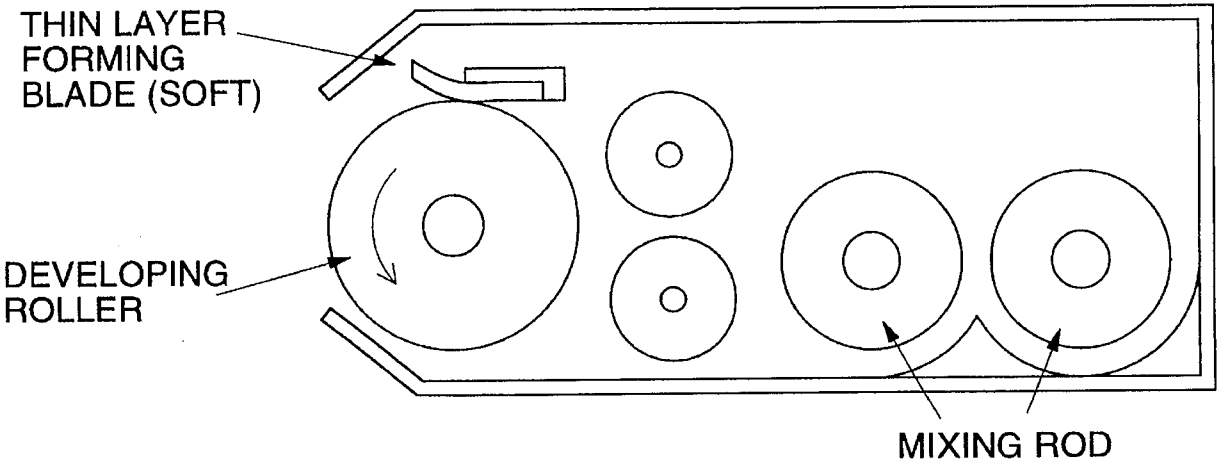
FIG. 2 illustrates a soft blade type development unit.
Figure 3:
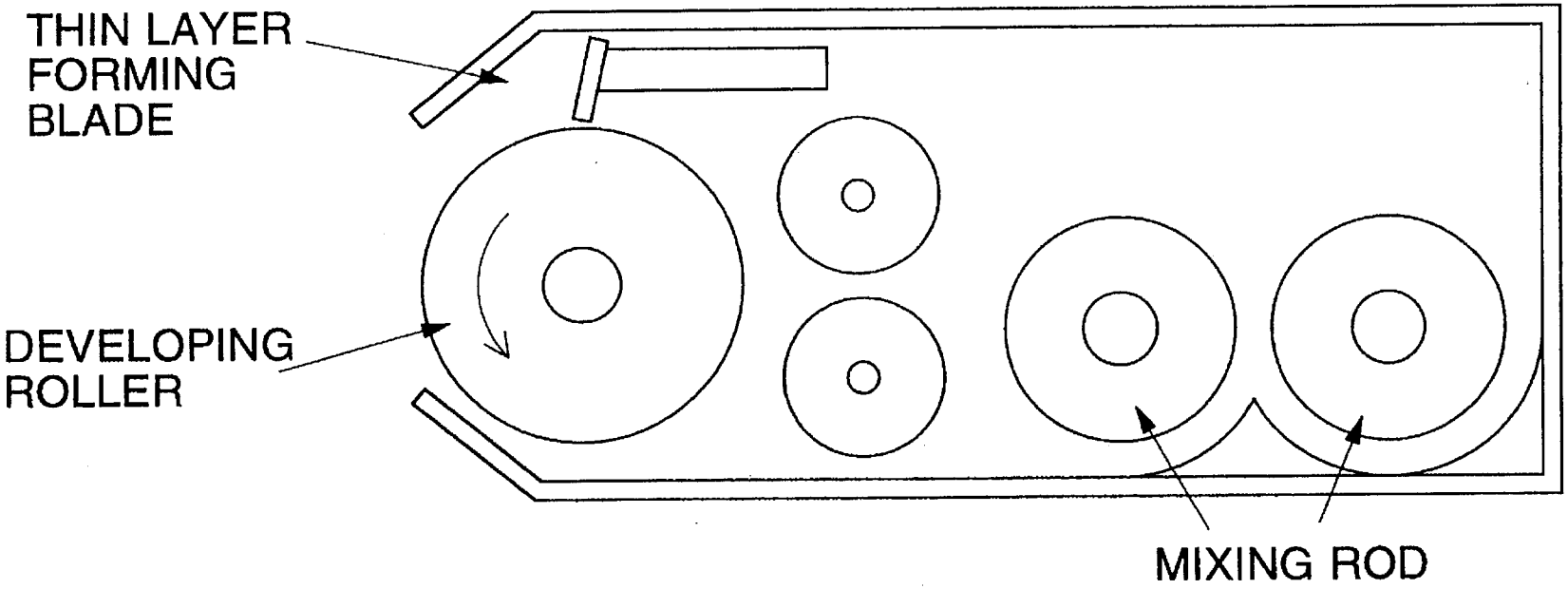
FIG. 3 illustrates a hard blade type development unit.

The means for achieving a thin layer having a developer layer thickness include the following means, for example, Item 1. a means for pressing a developer layer regulating member against the surface of a developing roller, (See FIG. 1);

Item 2. another means for regulating a developer layer by bringing an elastic blade into contact with the surface of a developing roller, (See FIG. 2); and Item 3. a further means for regulating a developer layer by keeping a specific gap between a non-elastic blade and the surface of a developing roller, (See FIG. 3).

This invention shall not be limited thereto, provided that a developer layer thickness can be specified within the scope mentioned above.

For example, when making use of such a thin layer forming means as mentioned in the above paragraph 1;

a diameter of the developer layer regulation member is preferable to be within the range of 1 mmØ to 10 mmØ;

concerning a rigidity of the toner layer regulation bar member, it is allowed to use the following materials, namely; a variety of magnetic metals including iron having a rigidity of not lower than $10^4$ $kg/cm^2$ and the alloys thereof; a hard resin containing a magnetic powder having a rigidity of the order of $(1.0 \text{ to } 10)\times10^4$ $kg/cm^2$; iron plated thereon with chrome or the like; and an iron alloy; and as a pressing force applied to a developing roller, it is reasonable to be within the range of 1 to 20 gf/mm and, particularly preferable to be within the range of 2 to 10 gf/mm.

When making use of such a thin layer forming means as mentioned in the above paragraph 2, as a pressing force applied to a developing roller, it is reasonable to be within the range of 1 to 20 gf/mm and, particularly preferable to be within the range of 2 to 10 gf/mm.

As such a non-elastic blade as mentioned above, it is allowed to use a polyurethane rubber sheet having a thickness of the order within the range of 1 to 5 mm, and a phosphor bronze plate, an SUS plate and an aluminum plate each having a thickness within the range of 50 μm to 500 μm.

When making use of such a thin layer forming means as mentioned in the above paragraph 3, a gap between a non-elastic blade and the surface of a developing roller is preferable to be within the range of 20 μm to 800 μm.

As such a non-elastic blade as mentioned above, it is allowed to use a phosphor bronze plate, an SUS plate and an aluminum plate each having a thickness within the range of 500 μm to 5,000 μm.

Physical Property Measurement Apparatus

In this invention, the following apparatuses and materials were used.

Magnesium compounds (See Table 1)

Particle-size: A number average particle-size obtained by observing the subject particles through a transmission type electron microscope Model JEM-2000FX (manufactured by Nihon Denshi Co.) and then by measuring them through an image analyzer Model SPICA (manufactured by Nihon Avionix Co.).

BET specific surface area: obtained through a BET specific surface area measurement apparatus Model Flow Sorb 2300 (manufactured by Shimazu Mfg. Works)

Carrier

Volume average particle-size: Microtrack SRA Model MK-II (manufactured by Nitsukiso Co., Ltd.)

Improvement of the durability of a layer coated on a carrier

Magnesium oxide contained in a coated layer can serve as a filler suitable for the coated layer so as to improve the durability of the coated layer and, at the same time, to increase an adhesion strength on the interface between the coated layer and a core, because it has a high affinity to a core member (or a magnetic particle), so that the coated layer cannot be peeled off.

EXAMPLES

NOW, the invention will be detailed with reference to the following examples. However, the embodiments of the invention shall not be limited thereto. In the examples given hereinafter, the term, "a part or parts", means "a part or parts by weight".

Example 1

Preparation of Toner

| | |
|---|---|
| Polyester resin | 100 parts |
| Carbon black | 10 parts |
| Polypropylene | 5 parts |
| Azo type chromium complex, (a negatively chargeable charge control agent) | 3 parts |

The above-given components were mixed up, kneaded, pulverized and then classified so as to obtain a powder having a volume average particle-size of 8 μm. Further, 100 parts of the resulting powder and 2.0 parts of hydrophobic silica fine particles (having a particle-size of 16 nm) were mixed up by making use of a Henschel mixer, so that toner A could be obtained.

Preparation of Carrier

When an external magnetic field of 1000 Oe was applied to a surface of a Cu—Zn ferrite particle having a specific gravity and a volume average particle size of 50 μm, a saturated magnetization of 25 emu/g was obtained on the surface of the ferrite particle. On the resulting surface of the ferrite, a copolymer having a composition of MMA/st=6/4 was added so as to have an average coated layer thickness of 2.0 μm and the additives shown in the following Table 1 were contained in the coated layer.

TABLE 1

| | Additive | | | |
|---|---|---|---|---|
| Carrier No. | Kind | Average particle-size (in nm) | BET specific surface area (in $m^2/g$) | Amount added (in wt %) |
| C-1 | MgO (single crystal) | 12 | 152 | 10 |
| C-2 | MgO (single crystal) | 15 | 155 | 10 |
| C-3 | MgO (single crystal) | 50 | 31 | 30 |
| C-4 | MgO (single crystal) | 111 | 14 | 30 |
| C-5 | MgO (poly-crystal) | 45 | 78 | 30 |
| C-6 | MgO (single crystal) | 12 | 152 | 60 |
| HC-1 | Nigrosine SO (a positively chargeable charge control agent) | 302 | 5 | 3 |
| HC-2 | R-972 (hydro-phobic silica) | 16 | 120 | 50 |
| HC-3 | — | — | — | — |

* An average particle-size indicates a number average particle-size

Preparation of Developer

The above-given carriers each in an amount of 460 g and 40 g of toner were mixed together by making use of a V-type mixer under the testing environment for 20 minutes, so that the developers for practical testing use were prepared, respectively.

Development conditions 1 for evaluating a practical test (on a plate having a developer layer thickness of 50 μm)

Evaluation on a Practical Test

Figure 4:
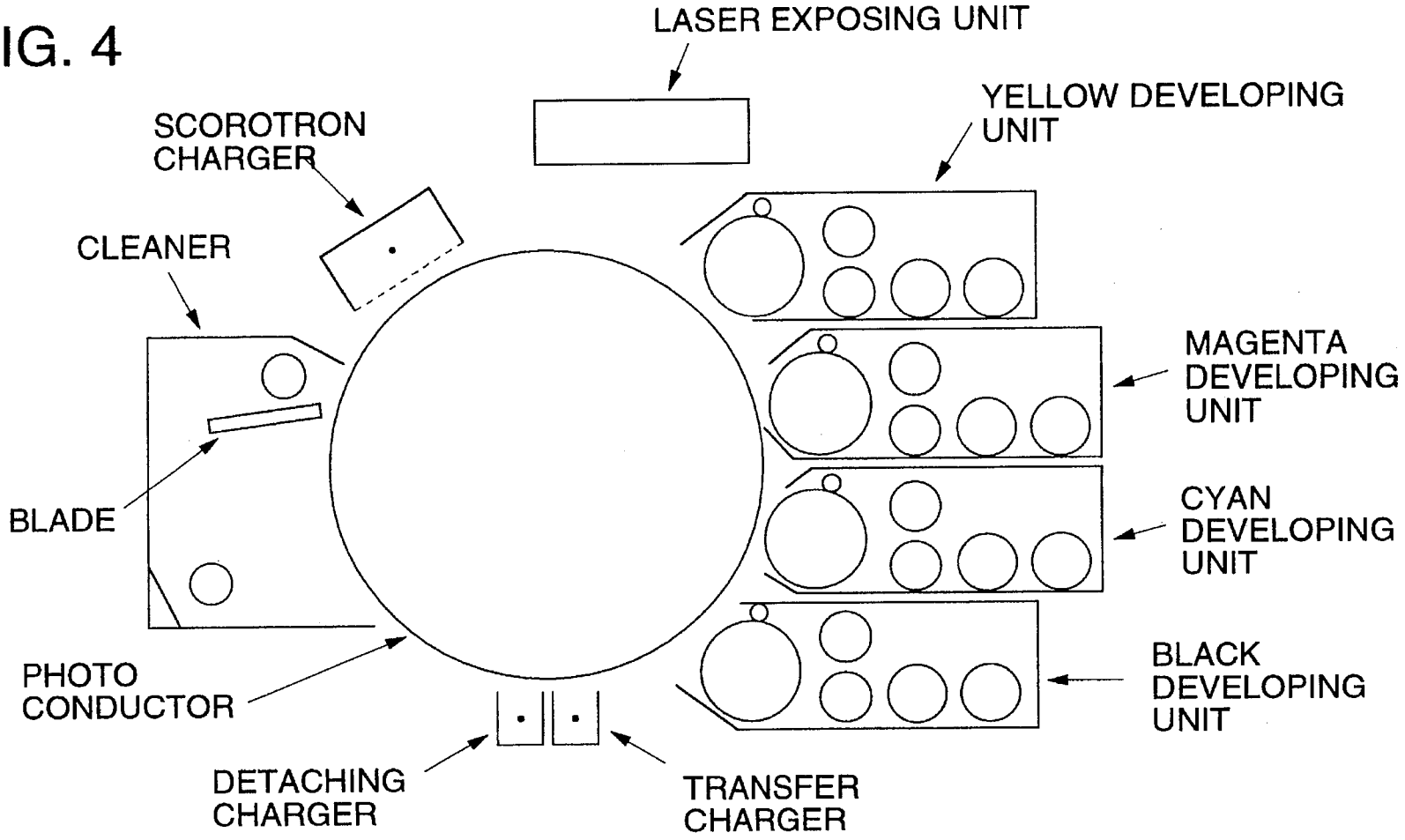
FIG. 4 is a schematic illustration of Konica 9028 (a modified model) used in the invention.

There used a Konica Modified Model 9028 (See FIG. 4), manufactured by Konica Corp.

Konica Modified Model 9028, manufactured by Konica Corp., is a non-contact, reversal development type multi-colored image forming apparatus that is comprised of an organic photoreceptor and a cleaning blade. The following development conditions were used therein. A developer adhering to the surface of a development sleeve was formed into a thin layer by making use of a magnetic stainless-steel made pressure regulation rod member (of the SUS 416 type having a curvature radius of 1.5 mm and a pressure regulation force of 5 gf/mm). The resulting thinned developer layer is transported to a development region in the state of non-contact with an organic photoreceptor. An electrostatic latent image resulted on the photoreceptor is then developed under the oscillating electric field obtained by applying an AC bias voltage to the development sleeve.

| | |
|---|---|
| Photoreceptor surface potential: | −700 v |
| DC bias: | −500 v |
| AC bias (Vp-p): | 1.6 kv |
| AC frequency: | 1.6 kHz |
| Development sleeve revolutions: (Developing roller revolution) | 400 rpm |
| Development gap: | 0.5 mm |
| Developer layer thickness in the developer layer forming section | 50 μm |
| Development conditions 2 for evaluating a practical test (on a plate having a developer layer thickness of 500 μm) | |

Evaluation on a Practical Test

There used a Konica Modified Model 9028, manufactured by Konica Corp.

Konica Modified Model 9028, manufactured by Konica Corp., is a non-contact, reversal development type multi-colored image forming apparatus that is comprised of an organic photoreceptor and a cleaning blade. The following development conditions were used therein. A developer adhering to the surface of a development sleeve was formed into a thin layer by making use of a magnetic stainless-steel made pressure regulation blade member (of the SUS 416 type having a thickness of 1 mm and a gap of 500 μm between the sleeve and the blade. The resulting thinned developer layer is transported to a development region in the state of non-contact with an organic photoreceptor. An electrostatic latent image resulted on the photoreceptor is then developed under the oscillating electric field obtained by applying an AC bias voltage to the development sleeve.

| | |
|---|---|
| Photoreceptor surface potential: | −700 v |
| DC bias: | −500 v |
| AC bias (Vp-p): | 2.2 kv |
| AC frequency: | 1.6 kHz |
| Development sleeve revolutions: | 400 rpm |
| Development gap: | 0.9 mm |
| Developer layer thickness in the developer layer forming section | 500 μm |

TABLE 2

| | | Development conditions for practical evaluation (1) | | | | | |
|---|---|---|---|---|---|---|---|
| | | | Fog density after | Carrier coverage | | Coated | |
| Sample No. | Carrier evaluated | Toner flying (in number) | making 50000 copies | (in wt %) | Varied amount (in %) | layer destroyed (in number) | Remarks |
| 1 | C-1 | 2 | 0 | 1.98 | −0.02 | 1 | Invention |
| 2 | C-1 | 3 | 0.004 | 1.98 | −0.02 | 2 | Invention |
| 3 | C-2 | 1 | 0.003 | 1.97 | −0.03 | 2 | Invention |
| 4 | C-2 | 4 | 0.003 | 1.95 | −0.05 | 1 | Invention |
| 5 | C-3 | 3 | 0.006 | 1.98 | −0.02 | 3 | Invention |
| 6 | C-3 | 3 | 0.008 | 1.96 | −0.04 | 2 | Invention |
| 7 | C-4 | 4 | 0.005 | 1.99 | −0.01 | 2 | Invention |
| 8 | C-5 | 1 | 0.006 | 1.99 | −0.01 | 3 | Invention |
| 9 | C-6 | 1 | 0.002 | 1.98 | −0.02 | 1 | Invention |
| 10 | HC-1 | 180 | 0.052 | 2.68 | +0.68 | 62 | Comparison |
| 11 | HC-1 | 387 | 0.062 | 2.91 | +0.91 | 52 | Comparison |
| 12 | HC-2 | 683 | 0.061 | 2.61 | +0.61 | 59 | Comparison |
| 13 | HC-2 | 520 | 0.073 | 2.70 | +0.70 | 69 | Comparison |
| 14 | HC-3 | 725 | 0.115 | 2.84 | +0.84 | 94 | Comparison |

TABLE 3

| | | Development conditions for practical evaluation (2) | | | | | |
|---|---|---|---|---|---|---|---|
| | | | | Carrier coverage | | Coated | |
| Sample No. | | Toner flying (in number) | Fog density at 50k c | in wt % | Amount varied (in %) | layer destroyed (in number) | Remarks |
| 15 | C-1 | 3 | 0 | 1.98 | −0.02 | 2 | Invention |
| 16 | C-1 | 2 | 0.001 | 1.97 | −0.03 | 1 | Invention |
| 17 | C-2 | 1 | 0 | 1.96 | −0.04 | 1 | Invention |
| 18 | C-2 | 2 | 0.003 | 1.98 | −0.02 | 2 | Invention |
| 19 | C-3 | 2 | 0.003 | 1.95 | −0.05 | 2 | Invention |
| 20 | C-3 | 4 | 0.002 | 1.95 | −0.05 | 3 | Invention |

TABLE 3-continued

| Sample No. | | Toner flying (in number) | Fog density at 50k c | Carrier coverage in wt % | Carrier coverage Amount varied (in %) | Coated layer destroyed (in number) | Remarks |
|---|---|---|---|---|---|---|---|
| | | Development conditions for practical evaluation (2) | | | | | |
| 21 | C-4 | 3 | 0.002 | 1.98 | −0.02 | 2 | Invention |
| 22 | C-5 | 2 | 0.003 | 1.95 | −0.05 | 3 | Invention |
| 23 | C-6 | 1 | 0.002 | 1.98 | −0.02 | 2 | Invention |
| 24 | HC-1 | 250 | 0.054 | 2.58 | 0.58 | 59 | Comparison |
| 25 | HC-1 | 281 | 0.041 | 2.92 | 0.92 | 86 | Comparison |
| 26 | HC-2 | 596 | 0.068 | 2.93 | 0.93 | 66 | Comparison |
| 27 | HC-2 | 832 | 0.054 | 2.65 | 0.65 | 72 | Comparison |
| 28 | HC-3 | 452 | 0.107 | 2.66 | 0.66 | 88 | Comparison |

(1) Fogginess

After completing 50,000 copies, the relative density of the fog produced in the white background of each copied image was measured through an image density measurement apparatus (a densitometer Model RD918 manufactured by Macbeth Co.)

(2) Toner flying inside the apparatus

The probe of a particle-counter (Model KC-01B manufactured by Lion Co., Ltd.) was set inside to the position 1 cm lower than the top of a development device. After completing 50,000 copies, the numbers of toner flied were counted in the 10 μm-size channel section.

(3) Destruction of coated layer

After completing 50,000 copies, 100 pieces of carrier were observed through a scanning type electron microscope and the carriers having coated layer destroyed were then counted and judged.

(4) Antispent property (coating rate)

After completing 50,000 copies, the resulting developer was washed with water and the toner was separated. After drying the rest of them, the carrier was obtained.

The coated layer of the resulted carrier was dissolved with methylethyl ketone. After that, the weight of the resulted magnetic material (or the magnetic particle) was measured and the coverage was calculated out in accordance with the following formula.

Formula (A-B)/B=Carrier coating rate (by wt %)

wherein

A: the weight of a carrier obtained after dried; and

B: the weight of a magnetic material obtained after dissolving a coated layer

As is obvious from Tables 2 and 3, even in an image forming process applied with a thin layer forming means giving a great stress to a developer, the invention was proved that any carrier was not destroyed, that any toner spent was not produced, that a charge rising property was excellent, and that any fog and toner flying were not produced for a long time.

Example 2

Developers were prepared in the same manner as in Example 1, except that the carriers were prepared in such a manner as shown in Table 4.

TABLE 4

| Carrier No. | Additive Kind | Average particle-size (in nm) | BET specific surface area (in $m^2/g$) | Amount added (in wt %) |
|---|---|---|---|---|
| C-1 | Hydroxidized MgO | 13 | 152 | 10 |
| C-2 | Hydroxidized $MgcO_3$ | 15 | 155 | 10 |
| C-3 | Hydroxidized MgO | 47 | 33 | 35 |
| C-4 | Hydroxidized $MgcO_3$ | 113 | 14 | 30 |
| C-5 | Hydroxidized MgO | 13 | 152 | 60 |
| HC-1 | Not added | — | — | — |
| HC-2 | Nigrosine SO (a charge control agent) | 302 | 5 | 3 |
| HC-3 | R-972 (hydrophobic silica) | 16 | 120 | 50 |

* An average particle-size was indicated by a number average particle-size.

The results of the evaluation made under the above-mentioned development conditions (1) and (2) will be shown in Tables 5 and 6, respectively.

TABLE 5

| Sample | Carrier evaluated | Developability Initial stage | Developability After 50,000 copies | Toner flying Initial stage | Toner flying After 50,000 copies | Fog density Initial stage | Fog density After 50,000 copies | Remarks |
|---|---|---|---|---|---|---|---|---|
| 1 | C-1 | 1.21 | 1.20 | 2 | 1 | 0.001 | 0.002 | Invention |
| 2 | C-2 | 1.23 | 1.22 | 0 | 2 | 0.002 | 0.002 | Invention |
| 3 | C-3 | 1.19 | 1.19 | 1 | 2 | 0.002 | 0.001 | Invention |

TABLE 5-continued

| Sample | Carrier evaluated | Developability Initial stage | Developability After 50,000 copies | Toner flying Initial stage | Toner flying After 50,000 copies | Fog density Initial stage | Fog density After 50,000 copies | Remarks |
|---|---|---|---|---|---|---|---|---|
| 4 | C-4 | 1.20 | 1.20 | 1 | 30 | 0.001 | 0.005 | Invention |
| 5 | HC-1 | 1.33 | 1.64 | 10 | 2089 | 0.009 | 0.031 | Comparison |
| 6 | HC-2 | 1.27 | 1.49 | 4 | 1789 | 0.009 | 0.027 | Comparison |
| 7 | HC-3 | 1.25 | 1.57 | 6 | 1799 | 0.007 | 0.024 | Comparison |

(1) Developability

A 2.0 cm×5.0 cm-sized patch having an original density of 1.3 was developed, and the toner amount thereof per $cm^2$ was calculated out.

(2) Toner flying and fog density

The resulted toner flying and toner density were evaluated by the same methods described in Example 1.

TABLE 6

| Sample No. | | Evaluation: Developability (in $mg/cm^2$) Initial stage | Developability 50k c | Toner flying (in number) Initial stage | Toner flying 50k c | Fog density Initial stage | Fog density 50k c | Remarks |
|---|---|---|---|---|---|---|---|---|
| 9 | C-1 | 1.23 | 1.22 | 1 | 1 | 0.001 | 0.003 | Invention |
| 10 | C-2 | 1.22 | 1.22 | 3 | 2 | 0.001 | 0.003 | Invention |
| 11 | C-3 | 1.19 | 1.19 | 2 | 2 | 0.001 | 0.002 | Invention |
| 12 | C-4 | 1.19 | 1.2 | 1 | 3 | 0.002 | 0.002 | Invention |
| 13 | C-5 | 1.22 | 1.22 | 2 | 1 | 0.001 | 0.02 | Invention |
| 14 | HC-1 | 1.35 | 1.67 | 21 | 2320 | 0.012 | 0.082 | Comparison |
| 15 | HC-2 | 1.28 | 1.55 | 32 | 3250 | 0.013 | 0.122 | Comparison |
| 16 | HC-3 | 1.25 | 1.66 | 12 | 4011 | 0.021 | 0.068 | Comparison |

As is obvious from Tables 5 and 6, the samples of the invention were proved to have all the excellent characteristics including the developability, toner flying and fog density.

Example 3

The developers were prepared in the same manner as in Example 1, except that the carriers were prepared in such a manner as shown in Table 7.

TABLE 7

| Carrier No. | Additive: Kind | Average particle-size (in nm)* | BET specific surface area (in $m^2/g$) | Amount added (in wt %) |
|---|---|---|---|---|
| C-1 | $Mg(OH)_2$ (single crystal) | 12 | 152 | 10 |
| C-2 | $Mg(OH)_2$ (single crystal) | 15 | 155 | 10 |
| C-3 | $Mg(OH)_2$ (single crystal) | 50 | 31 | 30 |
| C-4 | $Mg(OH)_2$ (single crystal) | 111 | 14 | 30 |
| C-5 | $Mg(OH)_2$ (poly-crystal) | 45 | 78 | 30 |
| C-6 | $Mg(OH)_2$ (single crystal) | 12 | 152 | 60 |

TABLE 7-continued

| Carrier No. | Additive: Kind | Average particle-size (in nm)* | BET specific surface area (in $m^2/g$) | Amount added (in wt %) |
|---|---|---|---|---|
| HC-1 | R-972 (hydro-phobic silica) | 16 | 120 | 50 |
| HC-2 | — | — | — | — |

*The average particle-size indicates a number average particle-size.

Preparation of Developer

The developers for practical testing use were prepared by mixing 460 g each of the above-mentioned carriers and 40 g of toner through a V type mixer for 20 minutes in the testing environment.

(1) Charged amount

The charged amount was measured by blowing for 60 minutes at a blow-off pressure of 1.0 $kg/cm^2$, by making use of a charged amount distribution measurement apparatus Model TB-200 manufactured by Toshiba, that is used in a blow-off method.

(2) Developability

A 2.0 cm×5.0 cm-sized patch having an original density of 1.3 was developed and the developed toner amount per $cm^2$ was calculated out.

TABLE 8

| Sample No. | Carrier evaluated | (1) Charged amount: Charged amount (in μc/g) 0 min | 5 min | 30 min | 1 hr | 3 hrs | 6 hrs | 12 hrs | 24 hrs | 1 wk. | Amount varied | Remarks |
|---|---|---|---|---|---|---|---|---|---|---|---|---|
| 1 | C-1 | 29.1 | 28.9 | 29.0 | 29.0 | 30.0 | 29.8 | 29.8 | 30.0 | 30.1 | 1.0 | Invention |
| 2 | C-2 | 29.0 | 29.3 | 29.6 | 29.6 | 29.6 | 29.7 | 29.7 | 30.0 | 30.2 | 1.2 | Invention |
| 3 | C-3 | 28.6 | 28.6 | 28.5 | 28.5 | 28.4 | 28.5 | 28.5 | 28.5 | 29.0 | 0.4 | Invention |
| 4 | C-4 | 29.2 | 29.0 | 29.1 | 30.2 | 30.1 | 30.2 | 30.3 | 30.1 | 29.6 | 0.4 | Invention |
| 5 | C-5 | 29.2 | 30.0 | 30.2 | 30.0 | 30.0 | 30.2 | 30.0 | 30.0 | 29.9 | 0.7 | Invention |
| 6 | C-6 | 29.1 | 29.2 | 29.1 | 29.2 | 29.2 | 29.2 | 29.3 | 29.4 | 29.5 | 0.4 | Invention |
| 7 | HC-1 | 28.5 | 24.2 | 21.2 | 18.6 | 16.2 | 13.6 | 12.9 | 11.0 | 8.4 | 20.1 | Comparison |
| 8 | HC-2 | 29.2 | 23.5 | 19.2 | 17.4 | 14.8 | 12.0 | 11.4 | 10.1 | 7.6 | 21.6 | Comparison |

The results of the evaluations made under the above-mentioned development conditions (1) and (2) will be shown in Table 9 and 10, respectively.

TABLE 9

| Sample No. | Carrier evaluated | Developability ($mg/cm^2$) 0 min | 5 min | 30 min | 1 hr | 3 hrs | 6 hrs | 12 hrs | 24 hrs | 1 wk. | Amount varied | Remarks |
|---|---|---|---|---|---|---|---|---|---|---|---|---|
| 1 | C-1 | 1.21 | 1.20 | 1.19 | 1.20 | 1.20 | 1.21 | 1.21 | 1.20 | 1.20 | 0.01 | Invention |
| 2 | C-2 | 1.27 | 1.24 | 1.22 | 1.20 | 1.20 | 1.25 | 1.25 | 1.25 | 1.23 | 0.05 | Invention |
| 3 | C-3 | 1.27 | 1.25 | 1.26 | 1.23 | 1.25 | 1.26 | 1.26 | 1.26 | 1.27 | 0 | Invention |
| 4 | C-4 | 1.21 | 1.22 | 1.22 | 1.20 | 1.21 | 1.22 | 1.21 | 1.21 | 1.21 | 0 | Invention |
| 5 | C-5 | 1.24 | 1.25 | 1.24 | 1.23 | 1.22 | 1.21 | 1.22 | 1.21 | 1.23 | 0.02 | Invention |
| 6 | C-6 | 1.24 | 1.24 | 1.24 | 1.24 | 1.24 | 1.23 | 1.23 | 1.23 | 1.23 | 0.01 | Invention |
| 7 | HC-1 | 1.20 | 1.23 | 1.24 | 1.26 | 1.32 | 1.39 | 1.50 | 1.52 | 1.54 | 0.34 | Comparison |
| 8 | HC-2 | 1.22 | 1.30 | 1.37 | 1.39 | 1.43 | 1.47 | 1.53 | 1.57 | 1.61 | 0.39 | Comparison |

TABLE 10

| Sample No. | Carrier evaluated | Developability ($mg/cm^2$) 0 min | 5 min | 30 min | 1 hr | 3 hrs | 6 hrs | 12 hrs | 24 hrs | 1 wk. | Amount varied | Remarks |
|---|---|---|---|---|---|---|---|---|---|---|---|---|
| 1 | C-1 | 1.25 | 1.24 | 1.25 | 1.24 | 1.24 | 1.25 | 1.25 | 1.24 | 1.25 | 0.01 | Invention |
| 2 | C-2 | 1.26 | 1.26 | 1.26 | 1.26 | 1.26 | 1.26 | 1.26 | 1.26 | 1.26 | 0 | Invention |
| 3 | C-3 | 1.25 | 1.25 | 1.25 | 1.25 | 1.25 | 1.25 | 1.25 | 1.25 | 1.25 | 0 | Invention |
| 4 | C-4 | 1.27 | 1.27 | 1.27 | 1.27 | 1.27 | 1.27 | 1.27 | 1.27 | 1.27 | 0 | Invention |
| 5 | C-5 | 1.26 | 1.26 | 1.25 | 1.26 | 1.25 | 1.25 | 1.24 | 1.24 | 1.24 | 0.02 | Invention |
| 6 | C-6 | 1.25 | 1.25 | 1.25 | 1.25 | 1.25 | 1.25 | 1.25 | 1.25 | 1.25 | 0 | Invention |
| 7 | HC-1 | 1.21 | 1.23 | 1.24 | 1.25 | 1.28 | 1.32 | 1.34 | 1.41 | 1.41 | 0.2 | Comparison |
| 8 | HC-2 | 1.22 | 1.21 | 1.3 | 1.32 | 1.34 | 1.36 | 1.39 | 1.39 | 1.42 | 0.2 | Comparison |

As is obvious from Tables 9 and 10, the samples of the present invention show an excellent improved result in developability respectively.

What is claimed is:

1. A method of developing a latent image on an image carrying member with a two component developer including a toner particle and a carrier particle, said method comprising (1) forming a developer layer on a developing conveyor by a magnet in said developer conveyor, wherein said toner particle comprises a binder resin and a colorant, said carrier particle comprises a magnetic particle and a resin layer coated thereon, wherein said resin layer comprises a resin and a substance selected from the group consisting of magnesium oxide, magnesium hydroxide, and a hydroxidized magnesium compound;

(2) controlling a thickness of said developer layer to be 20 μm to 800 μm by a developer regulator in close proximity to said developer conveyor;

(3) conveying said developer layer to said latent image on said image carrying member; and (4) conducting non-contact development of said latent image to form a toner image on said image carrying member.

2. The image forming method of claim 1, wherein said substance has a number average particle size range of 1 to 200 nm and a BET specific surface area range of 500 to 10 $m^2/g$.

3. The image forming method of claim 1, wherein said substance has a number average particle size range of 5 to 120 nm and a BET specific surface area range of 200 to 10 $m^2/g$.

4. The image forming method of claim 1, wherein said substance is added in an amount of 0.5 to 70% by weight to said coated layer.

5. The image forming method of claim 1, wherein said substance is added in an amount of 1 to 60% by weight to said coated layer.

6. The image forming method of claim 1, wherein said resin coated layer thickness of said carrier is from 0.5 to 4.5% in terms of weight of said carrier.

7. The image forming method of claim 1, wherein said resin coated layer thickness of said carrier is from 1 to 3.0% in terms of weight of said carrier.

8. The method of claim 1 wherein said developer regulator is a thin cylindrical layer-forming rod.

9. The image forming method of claim 6, wherein said substance has a single crystal structure.

10. The method of claim 1 wherein said substance has a number average particle size of 1 to 200 nm, and a BET specific surface area of 500 to 10 $m^2/g$, and said substance is added in an amount of 0.5 to 70% by weight, to said resin layer;

said developer regulator being a cylindrically shaped thin layer forming rod.

11. The image forming method of claim 8, wherein said cylindrically shaped thin layer forming rod has a diameter of 1 mm to 10 mm and a pressing force applied to a developing roller is 1 to 20 gf/mm.

12. The image forming method of claim 8, wherein said cylindrically shaped thin layer forming rod has a diameter of 1 mm to 10 mm and a pressing force applied to a developing roller is 2 to 10 gf/mm.

13. The method of claim 1 wherein said magnetic particle has a volume average particle size of 10 to 60 μm.

14. The method of claim 1 wherein said resin of said resin coated layer is a substance selected from the group consisting of styrene resin, acrylic resin, styrene-acrylic resin, vinyl resin, ethylene resin, rosin-denatured resin, polyamide resin, and polyester resin.

15. The method of claim 1 wherein said binder resin of said colored toner particle is a polyester resin.

* * * * *